US011072164B2

(12) United States Patent
Jantsch et al.

(10) Patent No.: US 11,072,164 B2
(45) Date of Patent: Jul. 27, 2021

(54) DEVICES FOR ALIGNING MAGNETIC OR MAGNETIZABLE PARTICLES, MACHINE, AND METHOD FOR PRODUCING OPTICALLY VARIABLE IMAGE ELEMENTS

(71) Applicant: KOENIG & BAUER AG, Würzburg (DE)

(72) Inventors: Andreas Jantsch, Veitshöchheim (DE); Edwin Kreps, Zellingen (DE); Michael Scheller, Unterpleichfeld (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/045,818

(22) PCT Filed: May 17, 2019

(86) PCT No.: PCT/EP2019/062812

§ 371 (c)(1),
(2) Date: Oct. 7, 2020

(87) PCT Pub. No.: WO2020/020507

PCT Pub. Date: Jan. 30, 2020

(65) Prior Publication Data

US 2021/0053339 A1 Feb. 25, 2021

(30) Foreign Application Priority Data

Jul. 25, 2018 (DE) ..... 10 2018 212 427.2
Jul. 25, 2018 (DE) ..... 10 2018 212 429.9

(51) Int. Cl.
*B41F 27/00* (2006.01)
*B41F 13/16* (2006.01)

(52) U.S. Cl.
CPC ..... *B41F 27/005* (2013.01); *B41F 13/16* (2013.01); *B41P 2213/91* (2013.01)

(58) Field of Classification Search
CPC ..... B41F 27/005; B41F 13/16; B41P 2213/91
See application file for complete search history.

(56) References Cited

U.S. PATENT DOCUMENTS 5,115,738 A 5/1992 Gruetzmacher et al.
10,016,971 B2 * 7/2018 Booth ..... B41F 13/0024
(Continued)

FOREIGN PATENT DOCUMENTS

DE 3614006 A1 10/1987
DE 004129373 A1 3/1993
(Continued)

OTHER PUBLICATIONS

International Search Report PCT/EP2019/062812 dated Jun. 26, 2019.

*Primary Examiner* — Leslie J Evanisko
*Assistant Examiner* — Leo T Hinze
(74) *Attorney, Agent, or Firm* — Mattingly & Malur, PC

(57) ABSTRACT

Devices are provided for aligning magnetic or magnetizable particles, which particles are contained in a coating that is applied on one side of a substrate, which substrate is in the form of a web or sheet. The device has a magnet cylinder, which is arranged in a transport path of the substrate to be conveyed and, in a region of the outer circumference of the magnet cylinder, the device has a plurality of devices for effecting a magnetic field, or magnet devices for short. Some or all of the magnet devices comprise a magnet which is rotatable by an associated motor. The magnet cylinder is rotatably arranged in frame walls of a frame. At least one transducer for contactless transfer of electrical energy or control signals from the outside is provided in or on the rotating magnet cylinder, which comprises a first transducer part fixed to the frame and a second transducer part fixed to the cylinder during operation.

14 Claims, 13 Drawing Sheets

(56) References Cited

U.S. PATENT DOCUMENTS

| | | | | |
|---|---|---|---|---|
| 2008/0148974 | A1* | 6/2008 | Hugel | B41F 33/0036 101/248 |
| 2011/0103912 | A1 | 5/2011 | Fronius et al. | |
| 2011/0168088 | A1 | 7/2011 | Raksha et al. | |
| 2015/0246526 | A1 | 9/2015 | Schwitzky | |
| 2017/0232727 | A1* | 8/2017 | Loginov | B41F 13/10 427/128 |

FOREIGN PATENT DOCUMENTS

| | | | | |
|---|---|---|---|---|
| DE | 102008058475 | A1 | 6/2009 | |
| DE | 102015214095 | A1 | 1/2017 | |
| EP | 2845732 | A2 | 3/2015 | |
| EP | 2885131 | A1 | 6/2015 | |
| EP | 2845732 | B1 | 3/2017 | |
| WO | 2010052063 | A1 | 5/2010 | |
| WO | 2016026896 | A1 | 2/2016 | |
| WO | WO-2016067247 | A1 * | 5/2016 | B41F 13/0024 |

* cited by examiner

DEVICES FOR ALIGNING MAGNETIC OR MAGNETIZABLE PARTICLES, MACHINE, AND METHOD FOR PRODUCING OPTICALLY VARIABLE IMAGE ELEMENTS

CROSS-REFERENCE TO RELATED APPLICATIONS

This application is the U.S. National Phase, under 35 U.S.C. § 371, of PCT/EP2019/062812, filed May 17, 2019; published as WO 2020/020507 A1 on Jan. 30, 2020, and claiming priority to DE 10 2018 212 429.9, filed Jul. 25, 2018 and to DE 10 2018 212 427.2, filed Jul. 25, 2018, the disclosures of which are incorporated herein in their entireties by reference.

FIELD OF THE INVENTION

The present invention relates to devices for aligning magnetic or magnetizable particles, a machine, and a method for producing optically variable image elements. The device is usable for aligning magnetic or magnetizable particles that are contained in a coating medium that is applied to one side of a web-format or a sheet-format substrate. The device has a magnetic cylinder which is arranged in the transport path of the substrate to be conveyed in which has, in the region of its outer circumference, a plurality of devices that induce a magnetic field, i.e. magnetic devices. Some or all of the magnetic devices each comprise a magnet that is rotatable by an associated motor. A machine, in particular a security printing press, is usable for producing optically variable image elements on a substrate. The machine comprises a printing substrate infeed, at least one printing unit having at least one printing couple, by means of which a substrate, that is guided along a transport path through the machine, is or can be printed at least on a first side, a product receiving unit for receiving the substrate that is treated in the machine, and a device for aligning magnetic or magnetizable particles, provided in the transport path of the substrate between the printing unit and the product receiving unit. The device comprises the magnetic cylinder which is arranged in the transport path of the substrate to be conveyed and which has, in the region of its outer circumference, the plurality of devices that induce the magnetic field, i.e., the magnetic devices. Some or all of the magnetic devices each comprise a magnet that is rotatable by its associated motor. A method is provided for producing optically variable image elements on a substrate.

From EP 2 845 732 B1, a printing press that comprises a screen printing unit and a device for aligning magnetic or magnetizable particles that are contained in the printing ink or the varnish is known, wherein the device is a cylinder, which has, on its circumference, a plurality of elements that induce a magnetic field, along with a dryer directed toward a point along the transport path at which point the substrate has not yet left the cylinder.

WO 2016/026896 A1 discloses a magnetically active device that comprises a rotatable magnet, along with a magnetic cylinder, which comprises on its circumference one or more such devices having rotatable magnets for aligning magnetic particles of a coating medium printed onto a substrate. Such a magnetic cylinder is preferably a component of a rotary printing press, in which the coating medium is applied by an intaglio method, a gravure printing method, a flexo printing method, or preferably a screen printing method.

US 2011/0168088 A1 likewise discloses a device for aligning magnetic or magnetizable particles of a printing ink by using a rotating magnet, the magnets being rotatable by the rotation of the cylinder via a transmission.

EP 2 885 131 A1 discloses a method for arranging at least two printing plates true to register and a system for controlling register, wherein in a preferred embodiment at least one transmitting unit and one receiving unit that is or can be wirelessly connected thereto is provided, by means of which electrical control signals and/or measurement signals and/or electric power are or can be transmitted via electromagnetic signals and/or fields between the rotating and/or rotatable plate cylinder on one hand and a stationary machine component, for example the frame of the printing unit, and in particular the press controller on the other hand.

DE 41 29 373 A1 discloses a device for the contactless transmission of electric energy and data from a stationary machine component to a rotating machine component of a printing press, in particular to a plate cylinder for adjusting the tilt of a printing plate.

DE 36 14 006 A1 discloses a sheet-feed offset printing press having a cylinder, in which an energy converter with a generator for obtaining electric energy is disclosed, which is used, for example, for driving electromotive servo elements.

WO 2010/052063 A1 discloses a processing machine with exchangeable tools, in which a rotary transducer for electric energy is provided, having a stator that is fixed to the machine and a rotor that is fixed to the spindle.

DE 41 29 373 A1 relates to a device for transmitting electric energy and data to a rotating component of a printing press, in particular to a plate cylinder. Here, adjustment elements for a register correction can be positioned, e.g. by loosening, adjusting and tightening the printing plates, even while the press is running.

DE 10 2015 214 095 A1 relates to a transmission device, in particular for a machine tool. In said device, energy is transmitted to the rotating part and data are exchanged bidirectionally between the stationary and the rotating part, both in a contactless manner.

DE 10 2008 058475 A1 discloses a plate cylinder to which electric energy and electrical control signals are supplied without contact. Pneumatic energy is also supplied to the cylinder from the same side.

WO 2016/067247 A1 relates to a printing press having a magnetic cylinder that comprises magnetic elements on its circumference, which can be removed in its entirety from the magnetization device.

SUMMARY OF THE INVENTION

The object of the present invention is to create devices for aligning magnetic or magnetizable particles, a machine, and a method for producing optically variable image elements.

The object is attained according to the invention by the arrangement of the magnetic cylinder rotatably in frame walls of a frame. At least one transducer is provided for the contactless transmission of electric energy or of control signals from the outside into or onto the rotating magnetic cylinder. A first transducer part is fixed to the frame and a second transducer part is fixed to the cylinder during operation. Some or all of the devices that induce a magnetic field are or can be arranged on the magnetic cylinder such that they are positionable in the circumferential direction thereof. In accordance with the present method, in a printing unit, a substrate is printed with a coating medium that contains magnetic or magnetizable particles. The printed substrate is guided over a magnetic cylinder downstream to align the magnetic or magnetizable particles or a portion thereof. The magnetic cylinder comprises, on its circumference, a plurality of devices that induce a magnetic field, i.e. magnetic device, each of which comprises a magnet that is rotatable by a motor. During at least one interval of time during the period in which the substrate is being guided over the magnetic cylinder, the magnets of all or some of the magnetic devices are rotated by their respective motors. Electric power is supplied and signals for controlling the motors are transmitted in a contactless manner from the outside into or onto the rotating magnetic cylinder via at least one transducer.

The advantages to be achieved with the present invention consist, in particular, in that substrates that have optically variable image elements with a three-dimensional appearance can be produced with great variability and/or high quality. In particular, wear and tear on parts can be reduced to a minimum.

The number of revolutions during the period of cooperation with the magnetic element can be optimized and/or operation with and without rotation can be selectively implemented.

A particularly appropriate device for aligning magnetic or magnetizable particles that are contained in a coating medium that is applied to one side of a web-format or sheet-format substrate comprises a magnetic cylinder, which is arranged in the transport path of the substrate to be conveyed and which has, in the region of its outer circumference, a plurality of devices that induce a magnetic field, i.e. magnetic devices, wherein some or all of the magnetic devices each comprise a magnet that is rotatable by an associated motor, and the magnetic cylinder is arranged rotatably in frame walls of a frame.

By means of a preferably contactless coupling via a transducer for the contactless transmission of electric energy and/or control signals from the outside into or onto the rotating magnetic cylinder, with said transducer comprising a transducer part that is fixed to the frame and a transducer part that is fixed to the cylinder during operation, a low-wear supply and/or transmission of control signals, for example, can be carried out.

In an advantageous embodiment of the contactless coupler that is based on a bus-based transfer of data, a high data rate and/or a transmission of parameters that can be expanded at any time can also be achieved. Since the electric power is also supplied via the same transducer, a space-saving and effective solution is created.

Particularly preferred is an embodiment in which some or all of the devices that induce a magnetic field are or can be arranged on the magnetic cylinder such that they can be positioned in its circumferential direction.

For this purpose, a transmission of electric power and/or signals to the magnetic device is preferably provided such that an electrical line connection between line branches, which are routed inside the magnetic cylinder, and the motor and/or the motor controller or the control logic system for controlling the motor is maintained, even with a significant displacement of the magnetic device in the circumferential direction.

In an advantageous embodiment, a contact, which is continuously producible in the circumferential direction over at least one circumferential section, can be produced between the magnetic device, which is continuously adjustable in the circumferential direction over at least one circumferential section, and the contact elements that are fixed to the cylinder, so that a variable positioning of the rotatable magnets is possible. A continuously existing contact, for example, is thereby ensured with a significant relative movement in the circumferential direction over, e.g., at least 10 mm, advantageously at least 50 mm. This is preferably accomplished by means of a contact in the form of sliding contacts, in particular in the manner of a slip ring.

In an alternative advantageous embodiment, on some or all of the magnetic devices to be operated, electrical connector elements can be provided, which can be placed in electrically conductive contact with ends of line branches that transmit the electric power and/or electrical control signals, via which electric power and/or control signals can be supplied to the relevant magnetic device.

Further details and variants may be found in the following exemplary embodiments and may be combined respectively with any of the embodiments set out above for the device, the cylinder, and/or the machine, provided such combination is not contradicted.

BRIEF DESCRIPTION OF THE DRAWINGS

Exemplary embodiments of the invention are illustrated in the set of drawings and will be described in greater detail below.

In the drawings.

DESCRIPTION OF PREFERRED EMBODIMENTS

Figure 1:
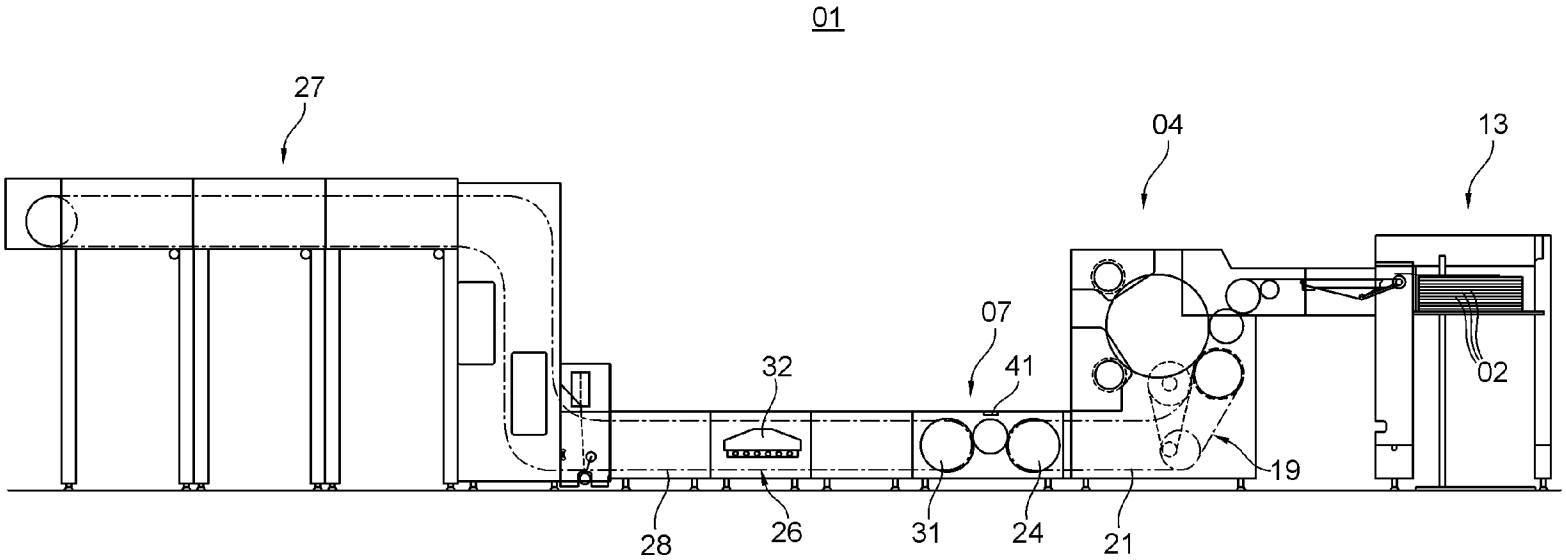
FIG. 1 shows an exemplary embodiment of a machine for producing optically variable image elements on a substrate.

A machine 01, e.g. a printing press 01, in particular a security printing press 01, for producing optically variable image elements 03 on a substrate 02, e.g. a web-format or sheet-format printing substrate 02, comprises an application system 04, e.g. a printing unit 04, by means of which optically variable coating medium 06, e.g. optically variable printing ink 06 or varnish 06, can be applied at least at one application position, e.g. print position, to at least a first side of the substrate 02, e.g. the printing substrate 02, over the entire surface or in sub-regions thereof, in the form of print elements 08, and comprises a device 07 for aligning particles responsible for the optical variability, which are contained in the optically variable coating medium 06 that is applied to the substrate 02 (see, e.g., FIG. 1). In the following, said device 07 is also referred to simply as the alignment device 07.

Figure 2:
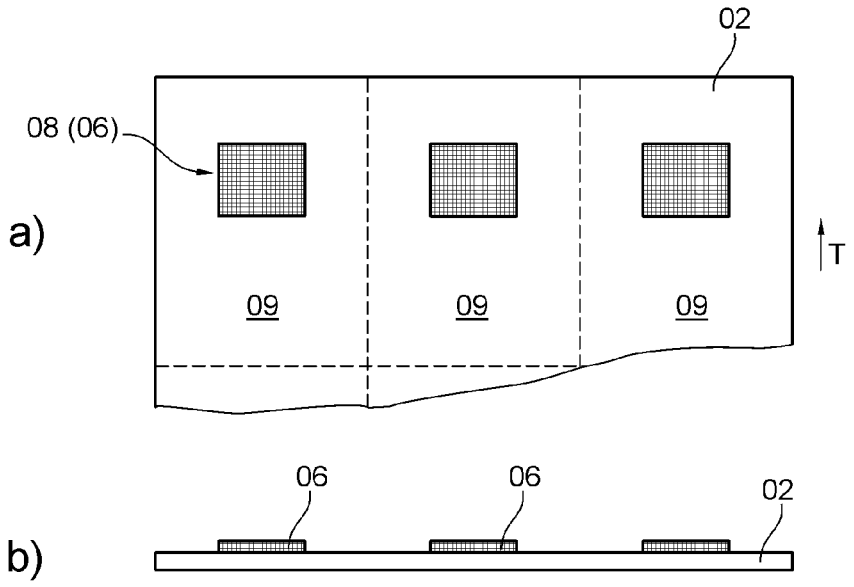
FIG. 2 is a schematic depiction of a substrate printed with optically variable coating medium in print elements.
Figure 3:
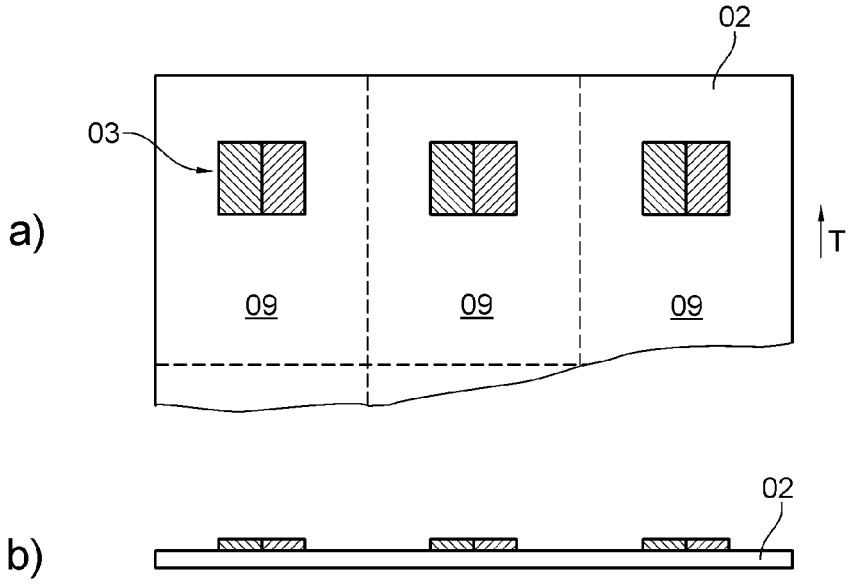
FIG. 3 is a schematic depiction of a substrate furnished with optically variable image elements.

The print elements 08 composed of variable coating medium 06, which are applied to the substrate 02 by the application system 04 prior to treatment by the alignment device 07, may correspond in size and position to the optically variable image elements 03 to be produced (see, e.g., FIGS. 2 and 3) or may optionally be larger than this, if applicable even extending over the surface of multiple copies 09. In the case of larger print elements 08, an optically variable image element 03 is not produced, for example, by means of alignment over the entire surface coated with the optically variable coating medium 06.

The particles responsible for optical variability here are magnetic or magnetizable, non-spherical particles, e.g. pigment particles, hereinafter also referred to simply as magnetic flakes, contained in the coating medium 06, e.g. the printing ink 06 or the varnish 06.

The machine 01 is preferably configured for producing copies 09, e.g. securities 09, in particular banknotes 09, or for producing intermediate products used for such securities 09, e.g. print images of multiple printing substrate sections containing such securities 09. The substrate 02, e.g. printing substrate 02, may be in the form of paper, e.g. cellulose-based or preferably cotton fiber-based paper, a plastic polymer, or a hybrid product of these. Before being coated in the aforementioned application system 04, said printing substrate may be uncoated or may already have been coated, it may be unprinted or may already have been printed one or more times, or otherwise mechanically processed. On a longitudinal section of web-format substrate 02 or on a sheet of a sheet-format substrate 02, multiple copies 09, e.g. banknotes 09 to be produced, preferably are or are to be arranged in a row side by side, and multiple such rows of copies 09 or the printed image thereof preferably are or are to be arranged one after another in the direction of transport T, during the course of processing of the substrate 02 (see, e.g., FIG. 2 and FIG. 3).

The machine 01 embodied as a printing press 01 can generally comprise one or more printing units 04 having one or more printing couples of any printing method. In a preferred embodiment, however, said machine comprises a printing unit 04 having at least one printing couple 11; 12 that operates according to the flexo printing method or preferably according to the screen printing method, by means of which the optically variable coating medium 06 is or can be applied to a first side of the printing substrate 02. The aforementioned printing methods, in particular the screen printing method, allow a thicker layer to be applied than is possible with other printing methods. The term the "first side" of the substrate 02 or printing substrate 02 has been chosen arbitrarily and is intended to denote the side of the printing substrate 02 to which the optically variable coating medium 06 is or has been or may be applied.

Figure 4:
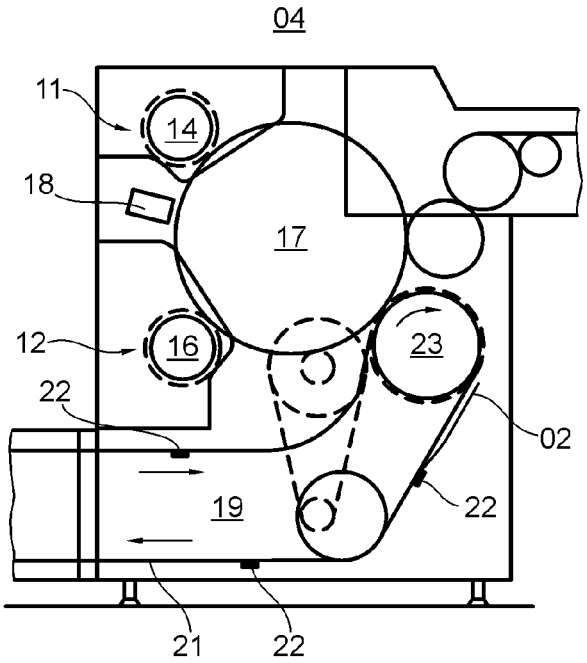
FIG. 4 shows an enlarged view of the printing unit from FIG. 1.
Figure 5:
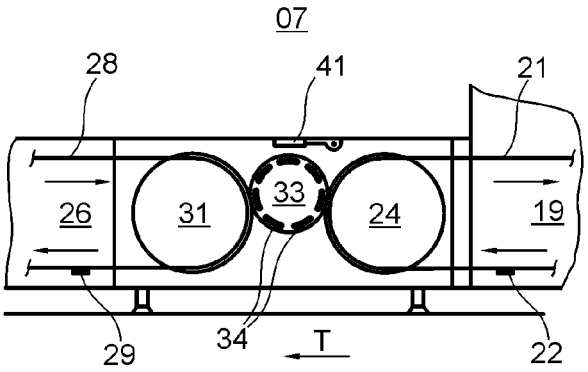
FIG. 5 shows an enlarged view of the device for aligning magnetic or magnetizable particles from FIG. 1.

In the depicted and preferred embodiment, the printing press 01 comprises a printing substrate infeed 13, e.g. a roll unwinder 13 or preferably a sheet feeder 13, by which the web-format or preferably sheet-format printing substrate 02, for example, is or can be fed, optionally via additional printing or processing units, to the printing unit 04, e.g. the flexo or more particularly the screen printing unit 04, having at least one printing couple 11; 12, e.g. a flexo or more particularly a screen printing couple 11; 12, which applies the optically variable coating medium 06. In the depicted and advantageous embodiment, two screen printing couples 11; 12 are provided, which are preferably combined in the same printing unit 04 and each of which forms, between a forme cylinder 14; 16, e.g. a screen printing cylinder 14; 16, and a shared impression cylinder 17, two print positions for the same side of the printing substrate 02, in this case the first side (see, e.g., FIG. 4). The embodiment as a screen printing couple 11; 12 also allows coating medium 06 to be applied in thicker layers. In the transport path between the two print positions, a drying and/or curing unit 18, e.g. a UV dryer 18, can be provided, which is directed toward the first side of a printing substrate 02 to be conveyed through the printing unit 04. One or both of the screen printing couples 11; 12 may apply or be capable of applying optically variable coating medium 06.

As an image-producing cylinder, the printing couple 11; 12 preferably comprises a forme cylinder 14; 16 comprising on its circumference a multiplicity of image-producing print motifs, in particular similar and/or identical, or groups of image-producing print motifs, in particular similar and/or identical, which are arranged in multiple columns that are spaced equidistant from one another transversely to the transport direction over a circumferential length that corresponds to the length of the print image, and in multiple rows that are spaced equidistant from one another in the transport direction over a cylinder width that corresponds to the width of the print image. In the case of a printing couple 11; 12 that operates by the flexo printing process, these print motifs are configured in the form of letterpress relief, and in the preferred case of a printing couple 11; 12 that operates by the screen printing process, said print motifs are configured in the form of screen printing stencils.

From the printing unit 04 that applies the optically variable coating medium 06, the printing substrate 02 can be fed via conveying means of a first conveyor system 19 to the alignment device 07. In the case of web-format printing substrate 02, said means may be one or more positively driven or non-driven rollers, via which the printing substrate 02 is or can be guided into the alignment device 07 on the input side thereof. In the preferred case of sheet-format printing substrate 02, i.e. individual printing substrate sheets 02 that pass through the machine 01, said conveying means are provided in the form of sheet-conveying means.

In an embodiment not shown here, said sheet-conveying means may be formed by one or more transfer cylinders or drums that receive the printing substrate sheet 02 from the printing unit 04, e.g. from the impression cylinder 17, and deliver it to the alignment device 07 on the input side thereof, optionally via one or more additional transfer cylinders or drums. Preferably, however, the first conveyor system 19 is embodied as a revolving gripper conveyor 19, e.g. what is known as a chain gripper system 19, which comprises continuous pulling means 21, e.g. continuous chains 21, revolving on both sides of the frame and carrying gripper bars 22 that extend transversely to the direction of transport T. The gripper bars 22 can grip the leading ends of the sheets and can thus transport printing substrate sheets 02 along the conveying path and deliver said sheets to the corresponding conveying or receiving means at the intended location. A sprocket 23; 24, also called a chain gripper wheel 23; 24, is preferably located at least in the region where the printing substrate sheet 02 is received from the printing unit 04 and in the region where said sheet is delivered to the alignment device 07.

After passing through the alignment device 07, which will be described in greater detail below, the printing substrate 02 can be guided via conveying means of an additional, e.g. second conveyor system 26 to a product receiving unit 27 for receiving the printing substrate 02 that has been treated and/or processed in the machine 01, e.g. a winder 27 in the case of web-format substrate 02 or a pile delivery 27 in the preferred case of sheet-format substrate 02. In the case of web-format printing substrate 02, said conveying means can again be one or more positively driven or non-driven rollers that carry the transport path of the first conveyor system 19 forward through the alignment device 07 and via which the printing substrate 02 is or can be guided into the winder 27 on the input side thereof. In the preferred case of sheet-format printing substrate 02, the conveying means are provided in the form of sheet-conveying means.

As above, said sheet-conveying means may be in the form of one or more transfer cylinders or drums, which receive the printing substrate sheet 02 from the alignment device 07 and deliver it to the pile delivery 27 downstream. Preferably, the second conveyor system 26, like the first, is configured as a revolving gripper conveyor 26, e.g. a chain gripper system 26 having revolving continuous pulling means 28, e.g. continuous chains 28, one or more sprockets 31 or chain gripper wheels 31, and gripper bars 29, by means of which the printing substrate sheets 02 are received from the transport path section of the alignment device 07 and are fed, e.g., to the pile delivery 27 (see, e.g., FIG. 1).

On the transport path leading away from the alignment device 07, an additional drying unit having one or more dryers 32, e.g. radiation dryers 32, directed toward the first side of the printing substrate 02 may be provided. In a refinement (not shown), a cooling unit is provided on the transport path between alignment device 07 and pile delivery 27, in particular downstream of the additional drying unit in the transport path between alignment device 07 and product receiving unit 27. Said cooling unit may be embodied, for example, as a cooling roller, which is located between the second conveyor system 26 coming from the alignment device 07 and a third conveyor system, e.g. likewise embodied as a revolving gripper conveyor, e.g. as a chain gripper system. In a further refinement, an inspection unit (not shown), e.g. a surface or line camera, can be provided and can be directed, for example, toward a lateral surface segment of the roller configured as a cooling roller or as some other type of roller, said surface segment lying in the transport path.

The alignment device 07 detailed below is generally unrestricted in terms of its embodiments, variants, and configurations, however it preferably is or can be provided in a machine 01 or printing press 01 as described above. In one advantageous embodiment, it is configured in the form of a module and can be integrated into the transport path of the machine 01 that is to be equipped using interfaces, on the input and output sides, to the open section ends of a conveyor system that continues upstream and downstream.

The device 07 for aligning optically variable image elements 03, e.g. for forming the optically variable effect in the optically variable coating medium 06 applied previously, e.g. in the form of print elements 08, to the substrate 02, in particular the printing substrate 02, comprises a defined transport path along which the substrate 02 to be conveyed through the alignment device 07 is guided or conveyed in a defined manner from an input region, in which the substrate 02 to be treated, which has the optically variable coating medium 06 on its first side, is or can be fed in via at least one magnetically active cylinder 33, i.e., magnetic cylinder 33, into an output region. Said first side that has the optically variable coating medium 06 is understood in particular as the side on which the optically variable coating medium 06 is or will be applied or has been applied upstream, for example, in the transport path by the application system 04.

It is also generally possible for two such cylinders 33 to be provided, which are arranged on the same side or on different sides of a substrate 02 to be conveyed along the transport path. The first or sole magnetic cylinder 33 is arranged in the transport path of the substrate 02 to be conveyed, preferably on the second side thereof, so that the first side of said substrate, which is coated, in particular upstream inline, with optically variable coating medium 06, faces outward during transport of said substrate via the first or sole magnetic cylinder 33.

The magnetic cylinder 33 has, in the region of its outer circumference, a plurality of devices 34 that induce a magnetic field, hereinafter also referred to simply as magnetic devices 34, each of which comprises at least one magnetic element 44 that is used by said devices to orient at least a portion of the magnetic or magnetizable particles of the coating medium 06 applied to the passing printing substrate. A device 34 for inducing a magnetic field, or magnetic device 34, is understood here generally as any magnetically acting device that permanently or selectably induces, at least toward the transport path side, a magnetic field (specifically of sufficient strength to align the particles contained in the coating medium 06 on the substrate 02 that is guided along said path as described here). Said magnetic elements 44 may be in the form of permanent magnets with or without engraving, solenoids, or combinations of one or more permanent magnets and/or one or more solenoids. Regardless of whether an individual or a combination of multiple permanent magnets and/or solenoids are involved, these magnetic arrangements associated with a magnetic device 34 and used for alignment are referred to collectively in the following simply as magnets 44. All or at least some of the magnets 44 are arranged rotatably on the operationally ready cylinder 33.

In the case of the aforementioned plurality of copies 09 per substrate 02, e.g. per substrate section or printing substrate sheet or substrate sheet 02, a plurality of rows of magnetic devices 34 are or can be provided over the circumference, spaced apart from one another transversely to the direction of transport T, which correspond, when rolled off onto the substrate 02, with the pattern of image elements 03 on the substrate 02 that are to be exposed to magnetic fields. With the aforementioned guidance of the substrate 02 over the magnetic cylinder 33, with the first side of said substrate, for example, facing outward as it is being transported over the first cylinder 33, the particles are aligned or oriented by means of the magnetic devices 34, i.e. in this case through the substrate 02, for example. The unloaded cylinder is also referred to here as the cylinder body, which can be loaded with magnetic devices 34 and acts as magnetic cylinder 33.

As mentioned above, some or all of the magnetic devices 34 comprise a magnet 44 that is rotatable about an axis R. The magnet 44 is positively rotationally driven, in particular by a motor. A motor 46, in particular in the form of an electric motor 46, which is comprised by the magnetic devices 34, can be integrated into the structure of the relevant magnetic device 34 or can be comprised as a separate component by said magnetic device 34. In an advantageous refinement, the motor 46 can be configured as a stepper motor or as a motor 46 that can be closed-loop controlled with respect to its speed and/or angular position using a speed and/or angular position sensor inside the motor or coupled to the load side thereof.

The axis R, in particular the axis of rotation R for the rotation of the magnet 44, preferably extends perpendicular to the cylinder shell surface, i.e. perpendicular to the cylinder axle and intersecting with the latter. At least, however, it extends at a taper with a maximum taper angle of 15° about this vertical to and through the cylinder axle.

The magnetic device 34 preferably is or can be detachably arranged on the cylinder 33 in such a way that, when mounted, it can be arranged at a defined location on the circumference of the cylinder 33 and can preferably be removed entirely from the cylinder 33 and/or can be positioned in the axial and/or the circumferential direction on the circumference of the cylinder 33.

Figure 14:
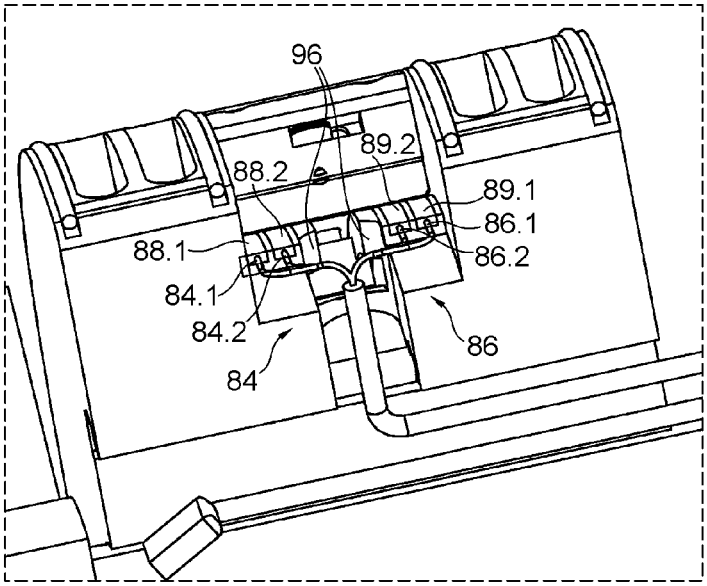
FIG. 14 shows a detail view from FIG. 13 with connection of the conductor paths on the magnetic cylinder.
Figure 15:
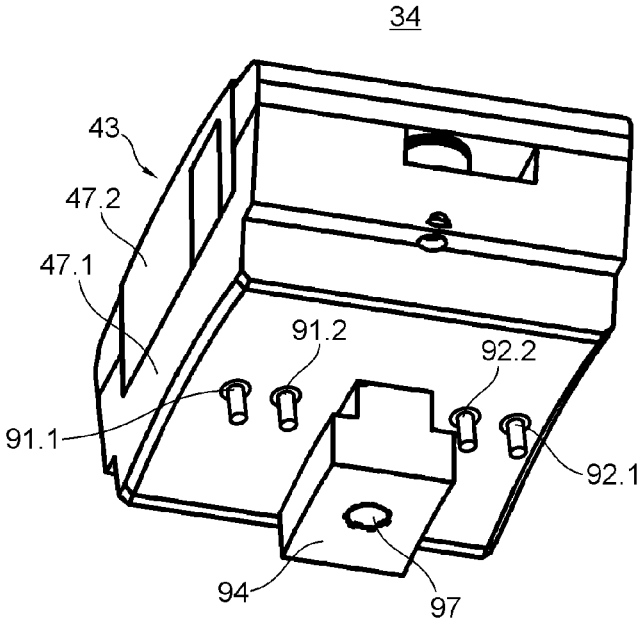
FIG. 15 shows a perspective, oblique view from the bottom of a magnetic device.
Figure 16:
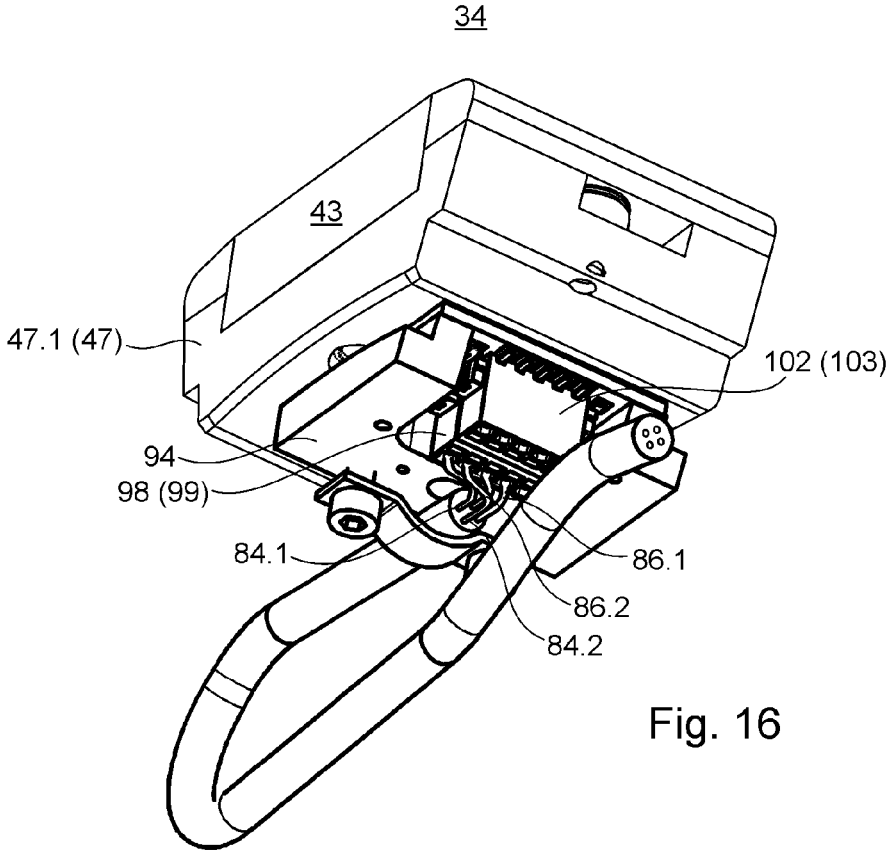
FIG. 16 shows an alternative embodiment of a magnetic device, obliquely from below.

For this purpose the magnetic device 34 comprises a single-part or multi-part support 47, for example a single-part or multi-part frame 47 or housing 47, which accommodates the magnet 44 and the motor 46 and which preferably comprises at least one connecting element 94, assigned to the relevant magnetic device 34, for the detachable and/or positionable arrangement of the magnetic device 34 on the magnetic cylinder 33. In an advantageous embodiment described here, the support 47, and thus the magnetic device 34, is configured as multi-part and comprises a supporting element 47.1, e.g. a base 47.1 or a receptacle 47.1 that is open outward and on which or in which a part 43 of the magnetic device 34 that comprises the magnet 44 and the motor 46, e.g. referred to here as the magnet unit 43, is or can be mounted (see, e.g., FIG. 14, FIG. 15 or FIG. 16). The magnet unit 43 may have a separate housing 47.2. In this embodiment, the supporting element 47.1 preferably has connector elements for supplying the electric power and/or the signals, and/or the at least one connecting element 94, which can be detachably arranged on the cylinder 33 in such a way that, in the mounted state, it is arranged at a defined location on the circumference of the cylinder 33 and, for example, can be removed entirely from the cylinder 33 and/or can be positioned in the axial and/or the circumferential direction on the circumference of the cylinder 33. The supporting element 47.1 already loaded with the magnet unit 43, for example, can then be positioned on the circumference, or it can be positioned on the circumference and can be loaded with the magnet unit 43 thereafter.

To mount the magnetic devices 34, generally any type of pairs of connecting elements 94; 96 may be provided that cooperate to produce a frictional or a positive connection and secure the magnetic device 34 on the circumference of the magnetic cylinder 33. In the present case, a frictional connection or clamping connection 94, 96 between the respective magnetic device 34 and the cylinder 33 is preferably provided, which permits a continuous positioning of the magnetic device 34 in the circumferential direction over at least a circumferential section of more than 10 mm, preferably more than 50 mm, especially preferably continuously over at least half the circumference of the cylinder. Said connection may be formed, for example, by a vertically movable connecting element 94 on the magnetic device 34, e.g. a clamping element 94, in particular a clamping block 94, which can be pulled through a groove from beneath, in particular on both sides, toward a connecting element 96 that is fixed to the cylinder, e.g. a brace 96, in particular a support rib 96 (see, e.g., FIG. 14, FIG. 15 or FIG. 16). Said pulling toward the brace 96 can be accomplished, for example, via a screw connection, e.g. a screw 97 that protrudes in the interior of the magnetic device 34 and through the base of the support 47, in particular supporting element 47.1, and that cooperates with a thread in the clamping element 94. Said connecting element 94 associated with the magnetic device 34 may be provided on the housing 47 or frame 47 of an operationally inseparable magnetic device 34 or on an aforementioned detachable supporting element 47.1.

Figure 6:
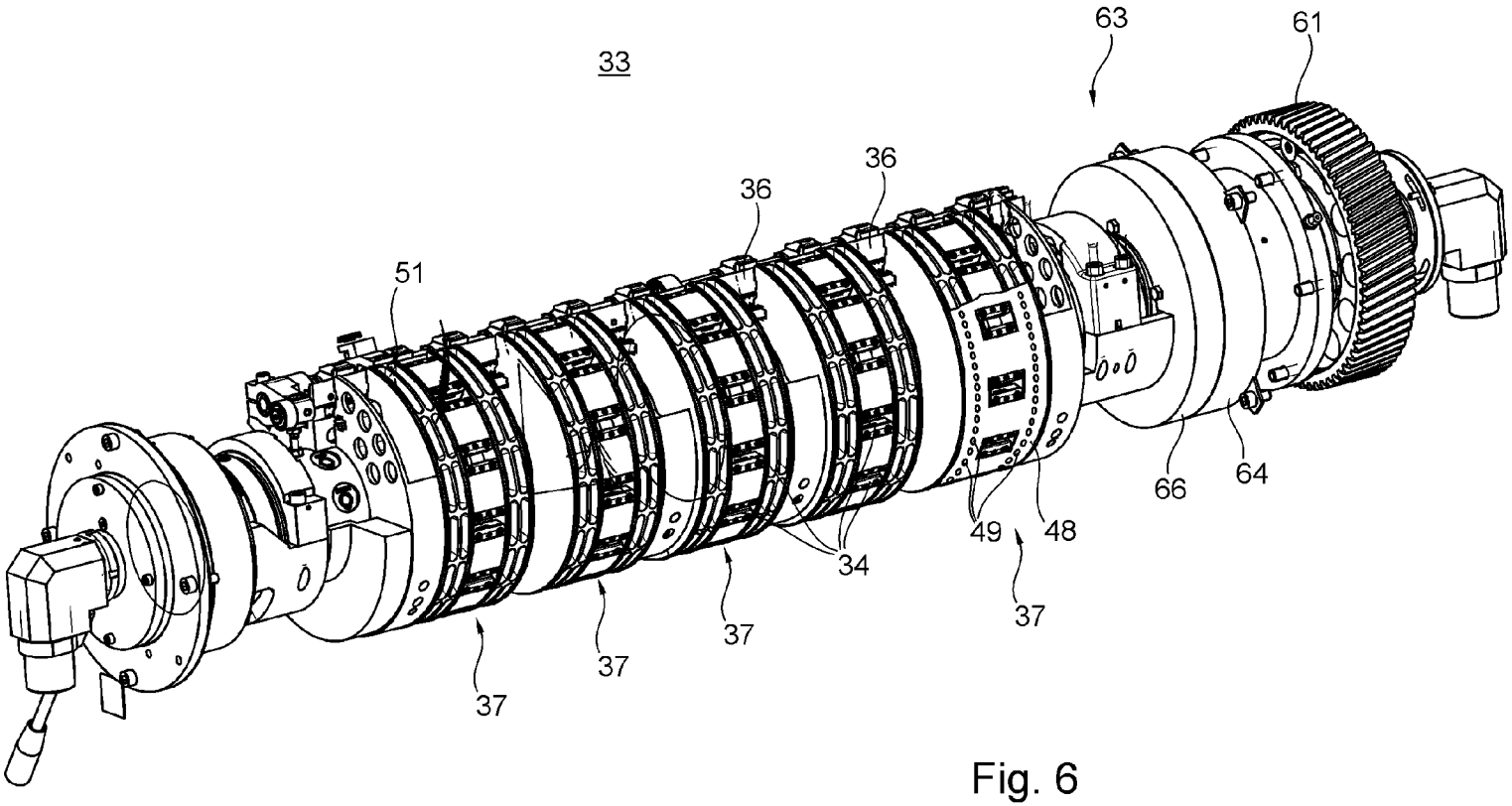
FIG. 6 shows an oblique, schematic view of an embodiment of a magnetic cylinder.
Figure 7:
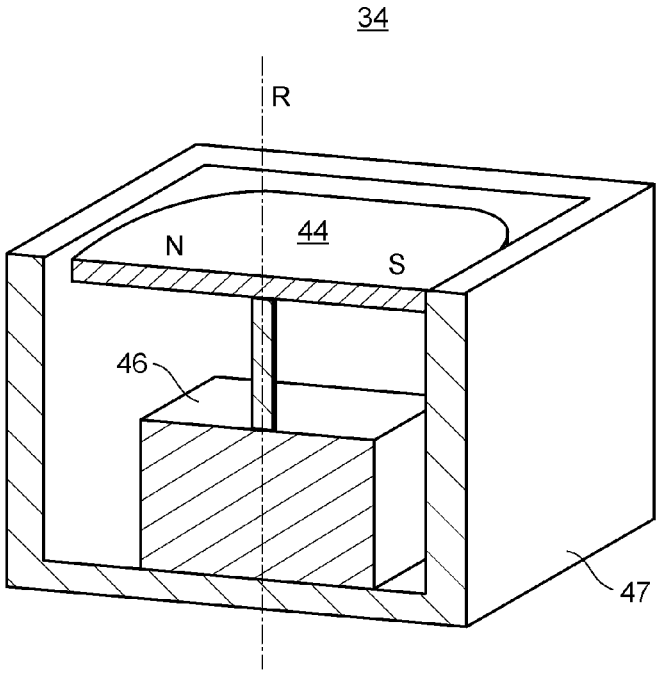
FIG. 7 shows a schematic sectional diagram of a device with a rotatable magnet for inducing a magnetic field.
Figure 8:
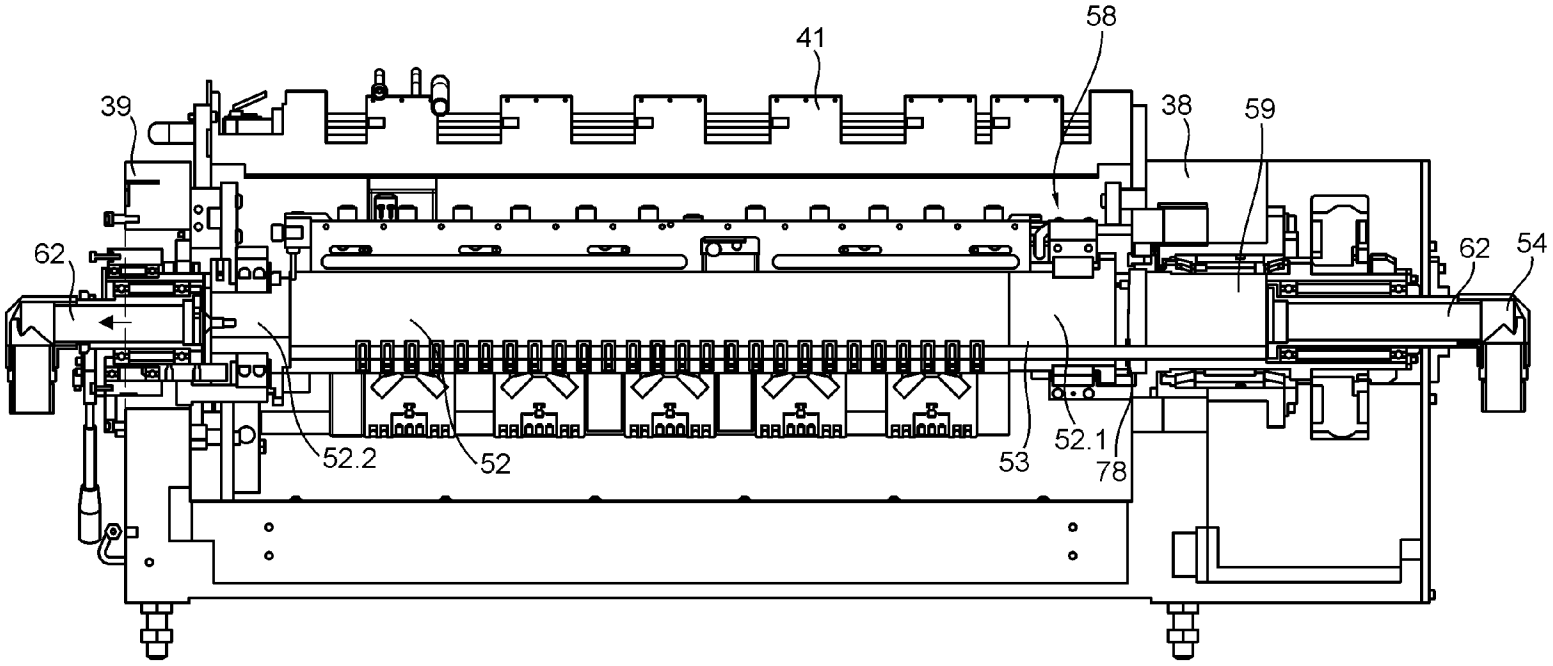
FIG. 8 shows a vertical section, extending transversely to the direction of transport, of the device for aligning magnetic or magnetizable particles.
Figure 9:
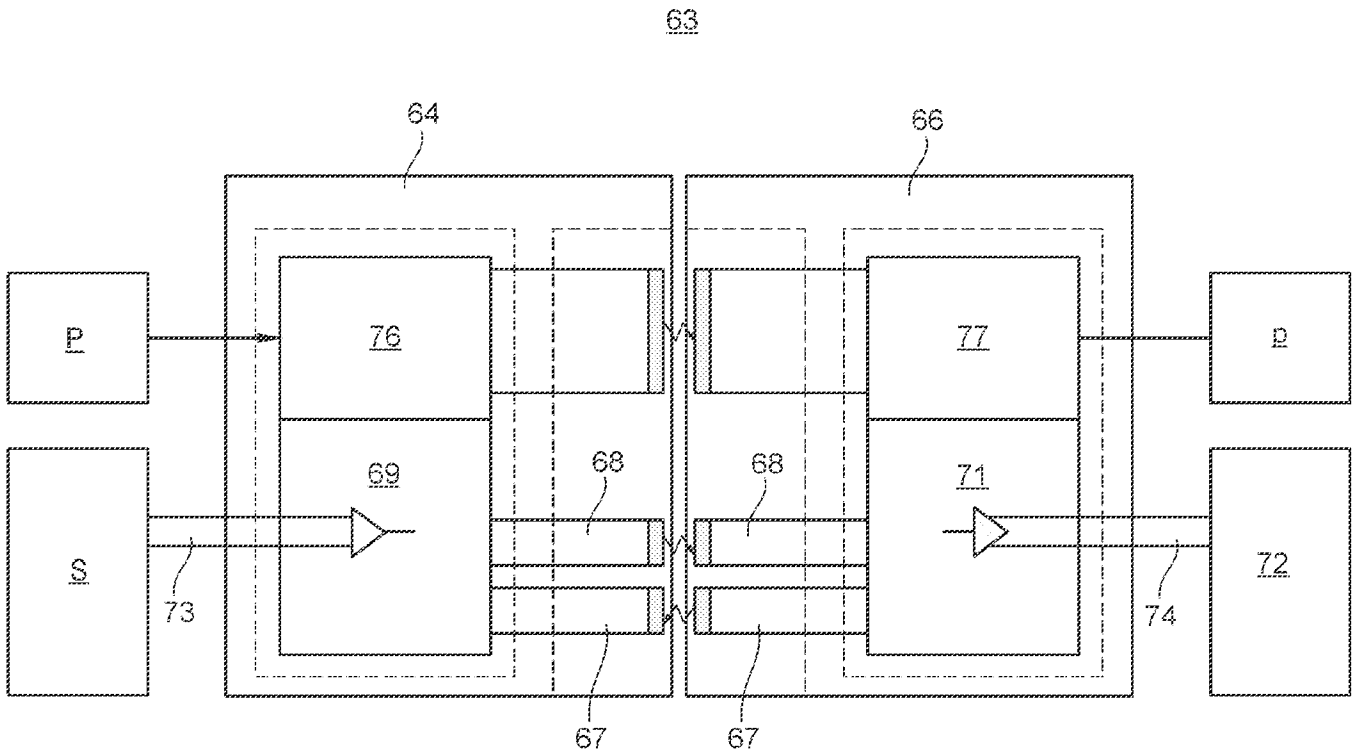
FIG. 9 is a schematic depiction of the signals transmission and supply of power for the magnetic cylinder.
Figure 10:
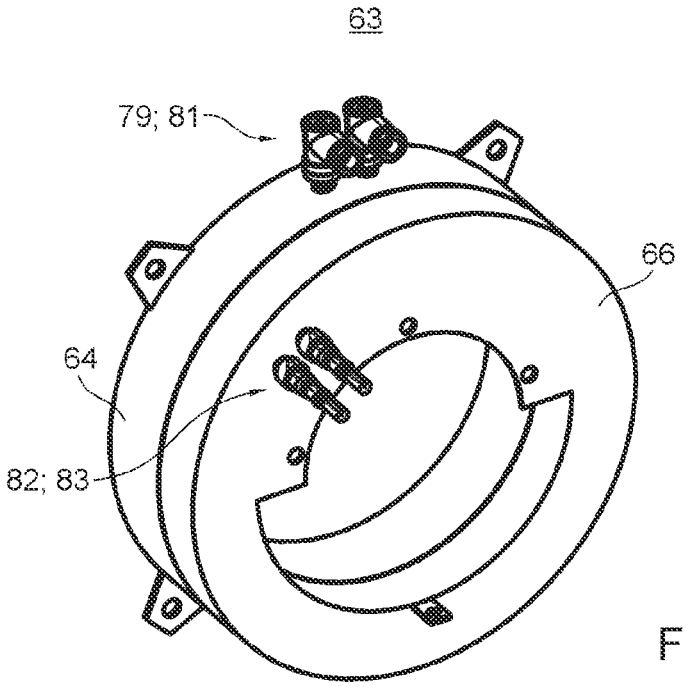
FIG. 10 is an enlarged depiction of the electromagnetic coupler.

The magnetic devices 34 can be arranged or arrangeable in or on a plurality of ring elements 37, e.g. between four and seven, in particular between four and six, which are spaced axially from one another and can preferably be positioned in the axial direction, with at least one, preferably a plurality of magnets 44 or magnetic devices 34, e.g. between two and twelve, advantageously between five and ten, in turn being arranged or arrangeable in or on said ring elements 37, one after another in the circumferential direction and preferably positionable in the circumferential direction (see, e.g., FIG. 6). The ring elements 37 are closed, in the region of their outer circumference, for example by circumferential coverings 48, e.g. covers 48 connected integrally to the ring ribs or attached cover plates 48, in which, e.g., the aforementioned suction openings 49 and recesses (not denoted) are provided at the respective location of the magnetic elements 44 (indicated by way of example for a part of the ring element 37 on the right in FIG. 6). Alternatively, a cover plate 48 that extends axially over all the ring elements 37 may be provided, which comprises the recesses and/or suction openings 49 at the relevant locations. The suction openings 49, in particular suction channels 51 therebeneath, are connected via lines to a vacuum pump. For example, a line 53, e.g. in the form of a borehole 53, is provided extending centrally in an axial direction through at least one, preferably through both of the cylinder journals 52.1; 52.2, and is connected at the end face via a rotary feedthrough 54 to a vacuum line or vacuum source, and on the cylinder side is conductively connected, for example via one or more supply boreholes 56 and preferably one or more valves 57, to the suction openings 49, in particular the suction channels 51.

In the case of web-format substrate 02, the magnetic cylinder 33 may be embodied without any holding means acting on the substrate 02. Optionally, the aforementioned suction air openings may be provided on the circumference, in which case said openings are connected to a vacuum pump and ensure that the substrate 02 rests securely on the lateral surface. For the preferred case here of sheet-format substrate 02, holding means 36, e.g. grippers 36 of what is known as a gripper bar, are preferably provided on the circumference of the cylinder 33; by means of said holding means, the leading end of a substrate sheet 02 to be conveyed via the cylinder 33 is or can be received and said sheet is or can be held over an angular range during a rotation of the cylinder 33. A magnetic cylinder 33 of this configuration serves simultaneously to transport the substrate 02.

The magnetic cylinder 33 is mounted rotatably on two cylinder journals 52.1; 52.2, which protrude beyond the cylinder barrel at the end faces thereof, in frame walls 38;

39, e.g. side parts 38; 39 of a frame that supports the components of the alignment device 07. The cylinder journals 52.1; 52.2 are also understood as the embodiment described here, in which the above "cylinder journals" 52.1; 52.2 are ends of a continuous shaft 52 that protrudes beyond the cylinder barrel. In a particularly preferred embodiment, the bearing is embodied such that the cylinder 33 can be removed from the frame and reinstalled therein. For this purpose, the two end-face journals 52.1; 52.2 are preferably supported on a bearing shell 58.1 of a multi-part radial bearing 58, which in the operational state is complemented by a second bearing shell 58.2 to form a closed bearing ring. In the operational state, one of the two journals 52.1; 52.2 is extended by a shaft segment 59, i.e. a shaft 59, e.g. a drive shaft 59, which, when the cylinder 33 is mounted, is connected for conjoint rotation on the output side to the journal 52.1; 52.2. On the drive side, the shaft 59 is connected, e.g. for conjoint rotation, to a drive wheel 61, e.g. helical cut gearwheel 61, which drives the rotation of the cylinder 33, and which is driven via a drive train, for example, together with another unit of the machine 01 or by a separately provided drive motor. The other journal 52.2; 52.1 can generally also be extended by a drive shaft and/or can comprise a line 53 for the suction air with an end-face opening.

The journal length and the positioning of the radial bearing 58 are preferably dimensioned such that the overall length of the cylinder 33 that comprises the journals 52.1; 52.2 is shorter than the inside width of the frame on at least one movement path for removal of the cylinder 33, which path extends radially, in particular substantially vertically, to just outside of the frame. Between a journal 52.1; 52.2 that comprises an end-face opening of a line 53 for the suction air and the extension thereof, e.g. in the form of a drive shaft 59 or a shaft segment 62 that serves, e.g. for the connection of suction air, directly to a rotary feedthrough 54, a single-part or multi-part seal 78 may be provided, which, when installed, extends the line 53 for the suction air through a central recess, whereas if the extension is provided by a shaft 59, said seal carries over the connection for conjoint rotation between journal 52.1; 52.2 and shaft 59 or at least accommodates a corresponding connection for conjoint rotation between shaft 59 and journal 52.1; 52.2. The seal 78 can comprise two wedge-shaped disks, which can be braced against one another along their sloping sides.

In a refinement, the bearing means for receiving the journals of the cylinder 33 and/or the journals 52.1; 52.2 of the cylinder 33, for example, are embodied such that the cylinder position in the frame can optionally be loaded with a simple transfer cylinder (without magnetic devices 34), rather than with the magnetic cylinder 33.

The magnetic cylinder 33, which can preferably be removed from the frame, is provided with at least one transducer 63 for transmitting electric energy and/or control signals from the outside into or onto the rotating cylinder 33. Said transducer 63 is preferably embodied as a contactless transducer 63, e.g. as an electromagnetic coupler 63, and serves both to transmit electric energy, for example for driving the motors 46, and to transmit signals for motor control, e.g. control parameters for control means that are carried along in the cylinder 33, e.g. a microprocessor controller, or control signals to be forwarded directly to the motor controllers. Such parameters or control signals may comprise a target status ("active"/"inactive") and/or the target rotary speed for the motor 46 in question and/or information regarding the current press speed and/or parameter values for parameterization of the control means and/or the motor controllers.

For this purpose, a coupler 63 configured as a contactless transducer 63 comprises two transducer parts 64; 66 that are rotatable relative to one another, specifically one transducer part 64 fixed to the frame and one transducer part 66 that is fixed to the cylinder, at least when the cylinder 33 is mounted or during operation, by means of which the control signals and/or control parameters are and/or can be transmitted via electromagnetic signals and/or fields. The transducer parts 64; 66 are preferably ring-shaped, particularly in the form of closed rings, and are each arranged concentrically around the rotational axis of the magnetic cylinder 33. In the preferred embodiment, the transducer parts 64; 66, which are preferably ring-shaped, are arranged adjacent to one another axially and have no mutual penetration in the axial direction, at least in terms of the active elements thereof that are involved in electromagnetic transmission, e.g. coils and/or conductor loops. Transmission then occurs via the end faces or the gap therebetween.

For transmitting control signals and/or control parameters to the cylinder 33, the transducer part 64 arranged, e.g. torsion-free on the frame acts, e.g., as a transmitting unit 64, and the transducer part 66 fixed to the cylinder acts as a receiving unit 66 that can be wirelessly coupled for signals communication to the former part. The control signals and/or control parameters can be transmitted via said coupling, in particular from a press controller S or a controller S integrated therein into the cylinder 33. If the cylinder 33 is removable, the transducer part 66 that is fixed to the cylinder during operation is arranged on the rotatable part that remains in the frame, e.g. the shaft segment 59 or 62, and thus remains in the frame when the cylinder 33 is removed. In this way, errors or a costly adjustment during reinstallation can be avoided.

In an advantageous embodiment, the coupler 63 is embodied for bidirectional signals transmission with a first transmission channel 67 for the above-described transmission of control signals and/or control parameters to the cylinder 33 and with a second transmission channel 68 for transmission of signals in the opposite direction, e.g. for the transmission of an actual status ("rotating"/"idle") of the motors 46 and/or of error messages from the motors 46, such as "defective", and/or regarding rotational positions and/or angular speeds of the motors 46, from the cylinder 33 back to the transducer part 64 that is fixed to the frame and from there to the external controller. For the second transmission channel 68, the transducer part 66 that is fixed to the cylinder acts as the transmitting unit 66 and the transducer part 64 that is fixed to the frame acts as the receiving unit 64.

The transmission of signals on at least the last segment from the external controller S to the transducer part 64 that is fixed to the frame, in particular a data logic system 69 comprised by said transducer part, the contactless transmission to the transducer part 66 that is fixed to the cylinder, in particular a data logic system 71 comprised by said transducer part, and from there to the motors 46, in particular the control logic system 72 of the motor controllers or of a central control means and/or the transmission of signals in the opposite direction takes place via a bus system 73; 74, preferably via a CAN bus 73; 74, and/or based on a standardized communications protocol for data buses, e.g. a CAN protocol, in particular CANopen®. Due to the consistent protocol, the segment between the two data logic systems 69; 71 is regarded as belonging to said bus system 73; 74, despite the fact that the transmission segment is partially electromagnetic and partially non-physical.

In the preferred embodiment, the electric energy for operating the motors 46 and, if applicable, energy-consuming control means is likewise transmitted in a contactless manner via the coupler 63. This transmission likewise occurs, e.g., generatively via electromagnetic induction. In this case, electric power is supplied, for example, from an external power source P to the transducer part 64 that is fixed to the frame, in particular to power electronics 76 comprised by said transducer part, and is then supplied in a contactless manner via electromagnetic induction to the transducer part 66 that is fixed to the cylinder, in particular to power electronics 77 comprised by said transducer part, where it ultimately serves to supply power p for operation of the motors 46. While the power source P supplies a 24V DC voltage, for example, the power electronics 77 of the transducer part 66 that is fixed to the cylinder supplies power at a voltage of 12V DC for a powered part p of the motors 46.

As a controller S that is outside of the cylinder 33, a PLC may be provided, which is in turn connected to the press controller S or is integrated therein. Between the controller S and the data logic system 69 of the transducer part 64 fixed to the frame, a converter may be provided, which converts the signals coming from the controller S to a CAN bus protocol, described above as preferred.

In principle, the transducer 63 may be provided on either of the two end faces of the cylinder 33. Since a shaft 52, for example, even one that remains on the frame in the case of an aforementioned possible removal of the cylinder 33, is already provided on the drive side, the transducer 63 is advantageously provided on the drive-side end face of the cylinder 33. Particularly if a suction air connection is provided on both sides, the aforementioned suction air connection at said drive-side end face is also additionally provided with, e.g., an aforementioned line 53, a rotary feedthrough 54, and optionally a seal 78.

Figure 11:
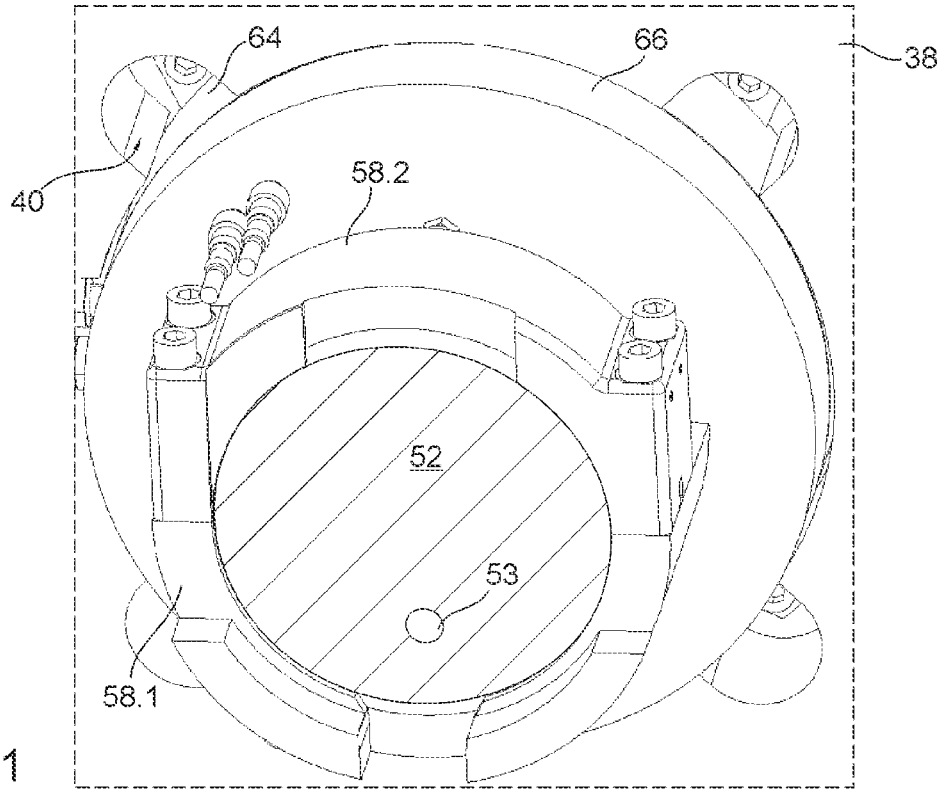
FIG. 11 shows a perspective view of the connection of the electromagnetic coupler to the frame and the magnetic cylinder.
Figure 12:
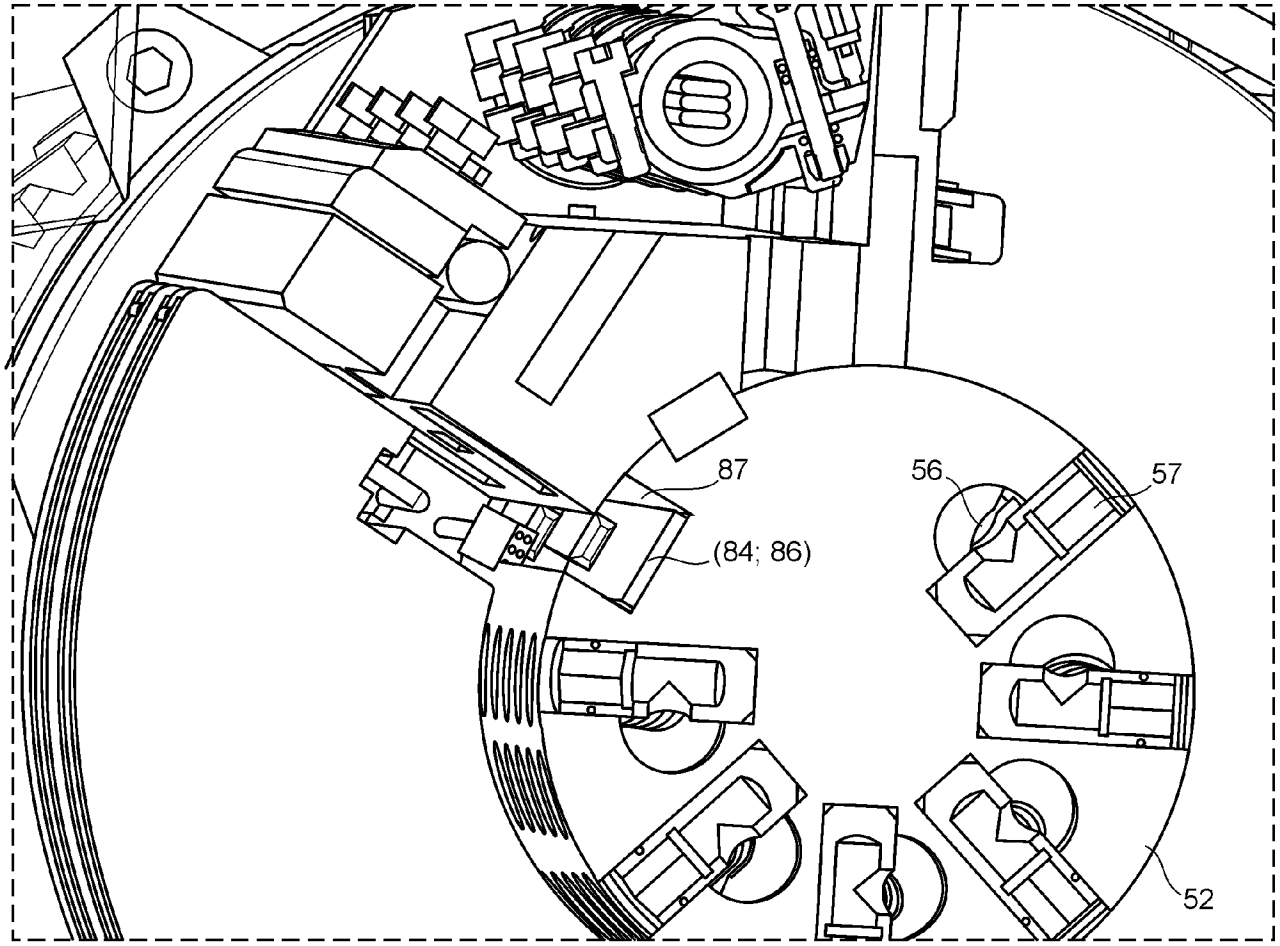
FIG. 12 shows a sectional view of an embodiment of the magnetic cylinder, extending perpendicular to the axle thereof.
Figure 13:
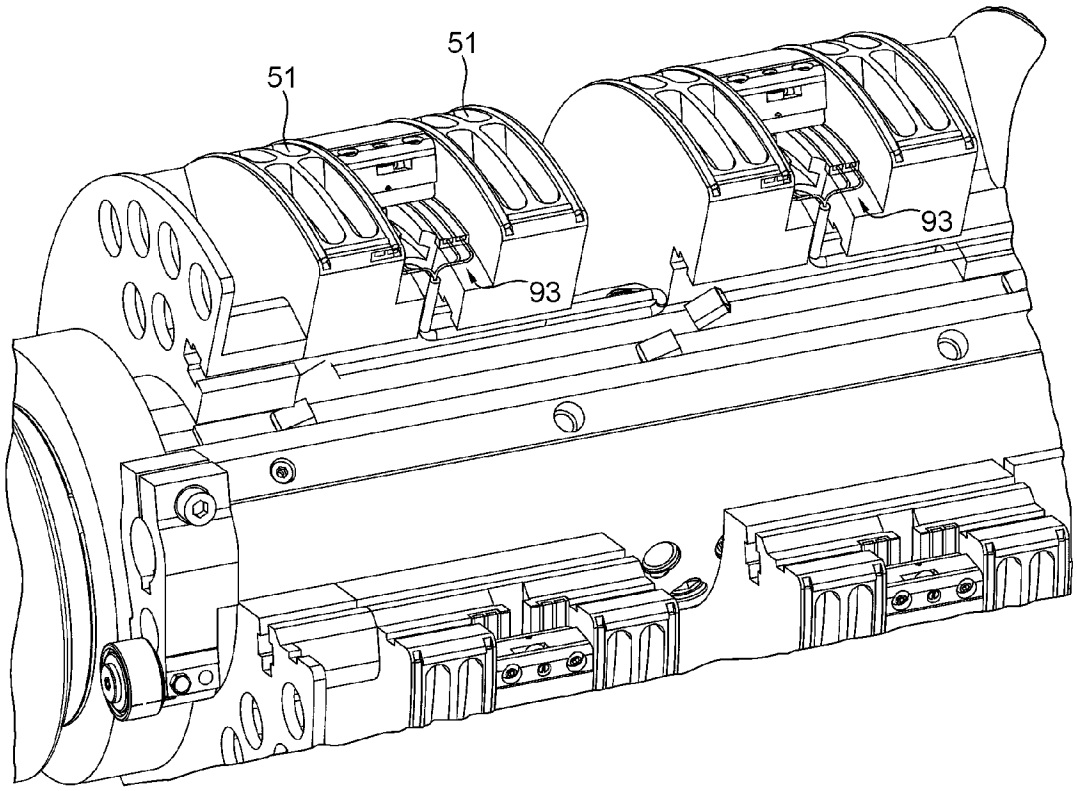
FIG. 13 shows an oblique view of a cutout comprising the gripper channel of the magnetic cylinder.

The transducer 63 is preferably arranged on the frame or on the relevant frame wall 38 in such a way that it can remain on the frame while the cylinder 33 together with the journals 52.1; 52.2 is lifted out of the frame. For this purpose, and to achieve the smallest possible inside width, at least the transducer part 64 that is fixed to the frame is arranged at least partially, for example, and preferably over its entire length in the axial direction, in a recess 40 in the frame wall 38, as seen in FIG. 11, such that it at least dips into the plane of the frame on the interior side of the frame, or preferably is held in its entirety in said plane. Even more advantageous is an embodiment in which the transducer part 66 that is fixed to the cylinder also dips at least partially into the plane of the frame or is even held in its entirety in said plane. In this embodiment, the inside width of the frame must be embodied as only slightly or insignificantly greater than the length of the cylinder 33 plus journals 52.1; 52.2.

The aforementioned signals and/or the electric power is fed to the transducer part 64 that is fixed to the frame via corresponding connectors 79; 81, and is discharged from the transducer part 66 that is fixed to the cylinder via corresponding connectors 82; 83 and into the cylinder 33.

For that purpose, a corresponding signals line 84 and/or a line 86 for power supply can be routed in an axially extending groove 87 in the shaft 52, and a corresponding number of line branches 84.1; 84.2; 86.1; 86.2 can branch off at the axial height of each group of magnetic devices 34 arranged one behind the other in the circumferential direction. For the purpose of accessibility, the groove 87 may be provided in or directly adjacent to a channel that accommodates the aforementioned gripper bar.

Figure 17:
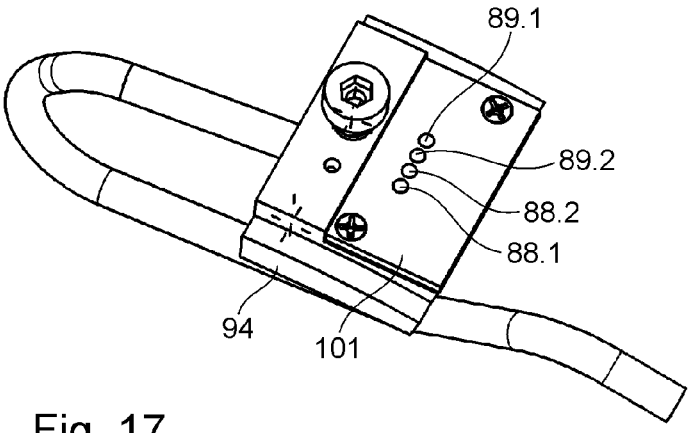
FIG. 17 shows a plan view of the contacts provided on a clamping element.
Figure 18:
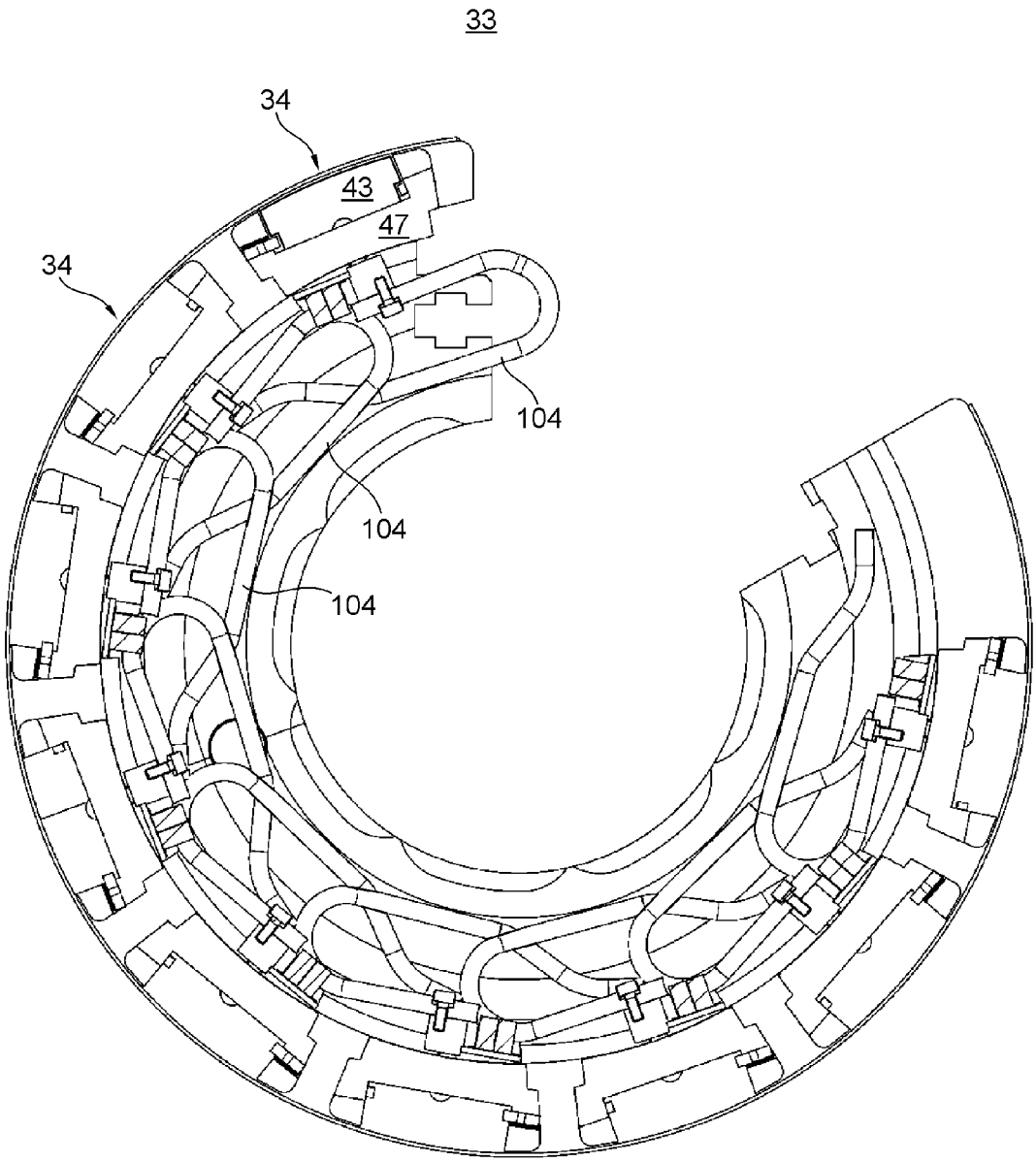
FIG. 18 is a cross-sectional depiction of a magnetic cylinder with wire harnesses installed in the form of loops for the transmission of energy and/or signals to the magnetic devices.

The line branches 84.1; 84.2; 86.1; 86.2 for transmitting signals and/or for supplying power can generally be routed directly on or in the magnetic devices 34 and connected, e.g. clamped there. However, the transmission of the power and/or control signals can also be implemented via contact pairs 88.1, 91.1; 88.2, 91.2; 89.1, 92.1; 89.2, 92.2 in the form of a sliding contact 88.1, 91.1; 88.2, 91.2; 89.1, 92.1; 89.2, 92.2, provided in the circumferential direction at least over a circumferential section, as depicted, e.g., in FIG. 14 and FIG. 15, or via respective line branches 84.1; 84.2; 86.1; 86.2 and detachable connector assemblies 98, 99 to the relevant magnetic device 34, having a connector part 98 provided at the line end and a corresponding connector part 99 to be assigned to the magnetic device 34, as depicted, e.g., in FIG. 16 to FIG. 18.

In an embodiment of the electrical connection that is particularly advantageous in terms of wiring complexity, for example, in which the connection is made via contact pairs 88.1, 91.1; 88.2, 91.2; 89.1, 92.1; 89.2, 92.2 embodied as sliding contacts 88.1, 91.1; 88.2, 91.2; 89.1, 92.1; 89.2, 92.2, these are preferably implemented as two-track sliding contacts 88.1, 91.1; 88.2, 91.2; 89.1, 92.1; 89.2, 92.2, which allow a variable positioning of the magnetic device 34 continuously in the circumferential direction over at least 10 mm, preferably at least 50 mm, ideally over at least half the circumference of the cylinder.

For smaller circumferential sections, this can generally be achieved with a section extending in the circumferential direction and having electrically conductive paths on the underside or on the side of the magnetic device 34 and with corresponding stationary, in particular spring-loaded contact pins on the cylinder body. It is also conceivable for electrically conductive path sections extending in the circumferential direction to be provided on both the magnetic device 34 and the cylinder body, with said sections nevertheless overlapping on a circumferential section with varying positioning of the magnetic device 34, producing a contact.

In a preferred configuration of the embodiment involving sliding contacts 88.1, 91.1; 88.2, 91.2; 89.1, 92.1; 89.2, 92.2, however, as supply-side contact elements 88.1; 88.2; 89.1; 89.2 on the cylinder 33 in the region of the circumferential sections designated for positioning of the magnetic devices 34, electrically conductive paths 88.1; 88.2; 89.1; 89.2, e.g. conductor paths 88.1; 88.2; 89.1; 89.2 or busbars 88.1; 88.2; 89.1; 89.2, extending in the circumferential direction, are provided in such a way that they are in electrically conductive contact with consumer-side or receiver-side contact elements 91.1; 91.2; 92.1; 92.2 correspondingly provided on the mounted magnetic devices 34. The contact elements 91.1; 91.2; 92.1; 92.2 assigned to the magnetic device 34 are arranged, e.g., on the support 47, preferably on the supporting element 47.1, and/or are preferably configured as spring-loaded contact pins 91.1; 91.2; 92.1; 92.2 which, upon installation of the magnetic device 34 on the cylinder 33, are pressed against the conductor paths 88.1; 88.2; 89.1; 89.2 and are deflected at least slightly, for example.

In a preferred embodiment of the magnetic cylinder 33, e.g. described above and comprising the ring elements 37, electrically conductive paths 88.1; 88.2; 89.1; 89.2 extend in sections or continuously over the entire circumferential section designated for possible loading with magnetic devices 34, in a recess 93 that runs in the circumferential direction. The paths 88.1; 88.2; 89.1; 89.2 can then extend along one or both of the opposing side walls, with the contact elements 91.1; 91.2; 92.1; 92.2 being correspondingly provided on the sides of the magnetic device 34. In a preferred embodiment, however, the contact elements 91.1; 91.2; 92.1; 92.2 are provided on the underside of the magnetic device 34, which faces the cylinder interior when said device is mounted, and cooperate with paths 88.1; 88.2; 89.1; 89.2 that extend in the circumferential direction in the recess 93 beneath the magnetic devices 34 that are or will be installed. For the transmission of signals and for supplying electric power, two contact elements 91.1; 91.2; 92.1; 92.2 and two paths 88.1; 88.2; 89.1; 89.2 are obviously provided for each, along with two line branches 84.1; 84.2; 86.1; 86.2 that serve the paths 88.1; 88.2; 89.1; 89.2.

In an embodiment that is advantageous, e.g. in terms of a particularly secure electrical contact for the supplying of electric power and/or signals, electrical connector elements are provided on each magnetic device 34 to be operated, in particular on the support 47 thereof, particularly on the supporting element 47.1, wherein ends of line branches 84.1; 84.2; 86.1; 86.2 for transmitting the electric power and/or the electrical signals are or can be attached into or onto said connector elements in a frictional, a positive, or optionally a bonded connection, and the electric power and/or the signals are or can be supplied to the magnetic device 34 in question via said connector elements. To enable variable positioning of the magnetic elements 34, the line branches 84.1; 84.2; 86.1; 86.2 preferably have additional length beyond the length that is actually required.

In a first variant of the embodiment, the connector elements that are or can be connected to the line ends are formed by inputs of a connector part 98 in the form of a contact strip 98, e.g. a terminal strip 98, which is arranged on the magnetic device 34. In the embodiment of the magnetic device 34 that cannot be operationally split, said connecting part can be provided on the support 47 of said magnetic device. In the preferred multi-part embodiment of the magnetic device 34, said connecting part is preferably arranged on the supporting element 47.1 that accommodates the magnet unit 43.

In the case of the multi-part embodiment of the magnetic device 34 as described above, the connector elements or a contact strip 98 of the described type is/are provided, for example, on a side of the supporting element 47.1 that faces away from the magnet unit 43, e.g. into the cylinder interior, with contact elements 88.1, 88.2; 89.1; 89.2 that are conductively connected to these connector elements or inputs being provided on the side that faces the magnet unit 43. For example, the contact elements 88.1, 88.2; 89.1; 89.2 are provided on the side of the clamping element 94 that faces the magnet unit 43, beneath a recess in the base of the supporting element 47.1 to be clamped, and the connector elements are provided on the inward facing side of the clamping element 94. The contact elements 88.1, 88.2; 89.1; 89.2 are arranged in relation to corresponding contact elements 91.1; 91.2, 92.1; 92.2 on the magnet unit 43, in particular in the base region thereof, such that when the magnet unit 43 is attached or inserted properly, for example through the recess in the base of the supporting element 47.1, the respective pairs of corresponding contact elements 88.1, 88.2; 89.1; 89.2 91.1; 91.2, 92.1; 92.2 are in electrically conductive contact. The corresponding contact elements 91.1; 91.2, 92.1; 92.2 are electroconductively connected to the motor 46 and/or to the control logic system 72 thereof.

The connector elements or the terminal strip 98 and the contact elements 88.1, 88.2; 89.1; 89.2 electroconductively connected thereto are provided, for example, on the two sides of a panel 101, e.g. a circuit board, made of electrically insulating material. For example, the connector elements, e.g. as inputs of the aforementioned terminal strip 98, are located on the side that faces the cylinder interior, and the contact elements 88.1, 88.2; 89.1; 89.2, e.g. as contact surfaces 88.1, 88.2; 89.1; 89.2, are located on the opposite side, which faces the magnet unit 43. The corresponding contact elements 91.1; 91.2, 92.1; 92.2 on the magnet unit 43 are also preferably configured here, for example, as spring-loaded contact pins 91.1; 91.2; 92.1; 92.2.

In a third embodiment for supplying energy and/or transmitting signals to the magnetic devices 34 that is particularly advantageous in terms of contact reliability and user friendliness, energy is supplied and/or signals are transmitted via at least one detachable connector assembly per magnetic device 34, wherein rather than the aforementioned contact strip or terminal strip 98, a connector part 99 embodied as a line-side plug connector 99 is provided, which can be detachably electroconductively connected to contacts of a plug connector (not visible in the figures) provided on the magnetic device 34. The plug connector on the magnetic device side may be arranged directly on the single-part housing 47 or frame 47 of the magnetic device 34, as described above for the connector elements, or on the supporting element 47.1 of the multi-part magnetic device 34.

Generally, for each magnetic device 34, corresponding line branches 84.1; 84.2; 86.1; 86.2 for supplying power and/or for signals transmission can branch off from the aforementioned signal line 84 and/or the aforementioned power supply line 86.

In a variant of the second and third embodiments that is advantageous, e.g. in terms of wiring complexity, however, some or all of the magnetic devices 34 in a group of magnetic devices 34 arranged one behind the other in the circumferential direction are electroconductively connected in series via line branch sections of line branches 84.1; 84.2; 86.1; 86.2 intended for energy transmission and/or signals transmission. For this purpose, on each magnetic device 34, for example, a group of input-side connector elements, for example an input-side terminal strip 98 or an input-side plug connector, and a group of output-side connector elements, for example an output-side terminal strip 102 or an output-side plug connector 103 are provided.

In an advantageous refinement, the line branch sections of the line branches 84.1; 84.2; 86.1; 86.2 for supplying power and/or for signals transmission are combined to form wire harnesses 104 that lead between two magnetic devices 34 that are adjacent to one another in the circumferential direction from the output-side connector elements of one magnetic device 34 to the input-side connector elements of the subsequent magnetic device 34. In the interest of an advantageous variability in positioning in the circumferential direction, the wire harnesses 104 are preferably configured as having a length that is greater than the distance between the connection points of two adjacent magnetic devices 34 in the circumferential direction and/or are arranged in the form of loops in the cylinder interior.

In an advantageous refinement, at least the line branches 84.1; 84.2 that are used for signals transmission and the interfaces with the control software that are assigned to the magnetic devices 34 are embodied as a bus system.

On the transport path of the substrate 02, in particular printing substrate 02, to be conveyed through the alignment device 07, at least one drying and/or curing unit 41 preferably is or can be arranged, e.g. on the first side of said substrate, which has the optically variable coating medium 06. Said unit is preferably directed, as viewed in the direction of transport T, toward a lateral surface segment of the magnetic cylinder 33, or toward a point on the transport path at which the substrate 02 to be conveyed is guided during operation, in particular with its second side, on the magnetic cylinder 33. With the aforementioned guidance of the substrate 02 in such a way that its first side faces outward during transport of said substrate via the magnetic cylinder 33, direct drying or curing of at least an outer layer of coating medium 06 that is applied to the substrate 02 takes place. The point, as viewed in the direction of transport T, toward which the first drying and/or curing unit 41 is directed is preferably located at least 90° behind the point at which the substrate 02 to be conveyed along its transport path runs onto the magnetic cylinder 33 and in front of the point at which the substrate 02 to be conveyed on its transport path via the magnetic cylinder 33 leaves the magnetic cylinder 33. This allows sufficient time for a rotation of the magnets 44 and a resulting alignment of the magnetic particles. The rotation can optionally be switched off when the drying and/or curing unit 41 is reached. Alternatively, the drying and/or curing unit 41 may be provided downstream of the magnetic cylinder 33 in the transport path. In that case, although the image that is produced is not "frozen" before the substrate 02 leaves the magnetic cylinder 33, here again a problem-free alignment without switching off rotation of the magnets, can be accomplished. The drying and/or curing unit 41 is preferably embodied as a radiation dryer 41, e.g. a UV dryer 41, in particular a UV LED dryer 41, and operates on the basis of electromagnetic radiation, e.g. with IR or preferably UV radiation. For this purpose, it comprises one or more radiation sources, e.g. IR or preferably UV light sources, in particular a multiplicity of UV LED's.

In a preferred embodiment of the aforementioned first drying and/or curing unit 41, said unit is configured to act, in at least one operating mode, on the substrate 02 to be treated in sections that are spaced apart from one another rather than continuously over the entire width of said substrate. These sections are preferably adjustable in terms of their position transversely to the direction of transport T of the substrate 02, and the respective effective width of said sections can optionally be defined. In a first variant, the drying and/or curing unit 41 can comprise a plurality of dryer heads, e.g. between four and seven, in particular between four and six, arranged side by side transversely to the direction of transport T and directed toward the transport path, which are preferably variable in terms of their position transversely to the direction of transport T. In a second variant that is particularly advantageous in terms of its variability, the drying and/or curing unit 41 can comprise a dryer element and/or curing element 41 that extends, in particular in the manner of a beam in the form of a light bar, in particular an LED light bar, transversely to the direction of transport T over at least the width of the maximum substrate width to be treated in the device 07, and that comprises a multiplicity of radiation sources, e.g. IR or preferably UV radiation sources, preferably UV LED's, side by side transversely to the direction of transport T. In this case, sections in which the substrate 02 is to be acted on can be formed by groups of active radiation sources or radiation sources that are to be activated, between which groups of inactive light sources or light sources that are not to be activated then lie. The position and preferably the width of the sections can then be varied by specifying which radiation sources are active or are to be activated.

In cases in which an additional magnetic cylinder is or may be provided in the transport path through the alignment device 07, an additional drying and/or curing unit can be provided on the transport path of the substrate 02 to be conveyed through the alignment device 07.

The magnetic cylinder 33 can generally be driven by a drive motor, e.g. a closed-loop position controlled servomotor, assigned to the magnetic cylinder 33. However, in an advantageous embodiment of the alignment device 07 or machine 01 configured for handling and treating sheet-format substrate 02, in particular substrate sheets 02, the magnetic cylinder 33 is driven by the revolving gripper conveyor 19; 26 disposed upstream or downstream, in particular via at least one of the two continuous pulling means 21; 28, in particular continuous chains 21; 28, of the revolving gripper conveyor 19; 26 in question, in particular the chain gripper system 19; 26, running on the sides of the machine.

On the circumference of the magnetic cylinder 33, a smoothing device, e.g. a plurality of axially spaced rollers or one or more cylinders, may be provided, which is or can be engaged over the substrate 02 on the cylinder 33 in the transport path of the substrate 02 between the run-up point thereof and the point of drying or curing.

In an advantageous embodiment of the alignment device 07, the magnetic cylinder 33 is equipped with its own vacuum pump for supplying vacuum pressure to the suction air openings 49 provided on the lateral surface.

The magnetic cylinder 33 may be configured as described above with coverings 48 that are restricted substantially to the ring elements 37 and may optionally have additional supporting rings between the ring elements 37, or may have a continuous covering 48, e.g. cover plate 48, in which regions are hollowed out for the magnetic elements 44 or magnetic devices 34 and which has boreholes, for example, as suction openings 49.

In an embodiment of the magnetic cylinder 33 that is advantageous in terms of format variability and/or variability in the position of the variable image elements 03 on the substrate 03 or the copies 09, at least two adjacent ring elements 37 but preferably all of said axially movable ring elements that contain or can be loaded with the magnetic devices 34 can be shaped, at least in a cover plate 48 that makes up part of the cylindrical shell surface of the cylinder 33, on the sides of said device that face one another in the axial direction of the cylinder 33, in a tooth-like or fan-like manner with protrusions, e.g. in the manner of tabs or lugs, and with corresponding recesses, e.g. cutouts or troughs, and can be offset in the circumferential direction such that when two adjacent ring elements 37 move axially toward one another, the tooth-like widened sections of one ring element 37 can dip into the corresponding recesses of the other ring element 37. This enables the printing substrate 02 to be supported as uniformly as possible with potential variations in spacing.

While preferred embodiments of devices for aligning magnetic or magnetizable particles, a machine, and a method for producing optically variable image elements, all in accordance with the present invention, have been set forth fully and completely hereinabove, it will be apparent to one of skill in the art that various changes could be made thereof, without departing from the true spirit and scope of the present invention, which is accordingly to be limited only by the appended claims.

The invention claimed is:

1. A device for aligning one of magnetic and magnetizable particles that are contained in a coating medium that is applied to one side of one of a web-format and a sheet-format substrate comprising:

a magnetic cylinder, which is arranged in a transport path of the substrate to be conveyed and which magnetic cylinder has, in a region of an outer circumference of the magnetic cylinder, a plurality of magnetic devices that induce a magnetic field;

wherein at least some of the magnetic devices each comprise a magnet that is rotatable by an associated motor;

wherein the magnetic cylinder is arranged rotatably in frame walls of a frame;

wherein at least one transducer is provided for contactless transmission of one of electric energy and of control signals from an outside of the magnetic cylinder one of into and onto the magnetic cylinder, the transducer comprising a first transducer part that is fixed to the frame and a second transducer part that is fixed to the magnetic cylinder during operation;

wherein a bus system is provided for the contactless transmission of signals to the second transducer part that is fixed to the magnetic cylinder; and one of wherein the second transducer part, that is fixed to the magnetic cylinder during operation, is arranged on a shaft segment that remains in the frame when the magnetic cylinder is removed from the frame, and, that, for operation, the shaft segment can be connected for conjoint rotation to a cylinder journal of the magnetic cylinder, and wherein the first transducer part that is fixed to the frame is arranged, at least Partially, in a recess in the frame wall such that the first transducer part at least dips into a plane of the frame on an interior side of the frame.

2. The device according to claim 1, one of wherein the transducer is embodied as an electromagnetic coupler and wherein the first and second transducer parts are configured as ring-shaped, each being arranged concentrically around an axis of rotation of the magnetic cylinder, and wherein the first and second transducer parts are arranged axially adjacent to one another and are configured without mutual penetration in an axial direction of the magnetic cylinder with regard to ones of their coils and conductor loops that are involved in the transmission of signals.

3. The device according to claim 2, wherein, for bidirectional signals transmission, a coupler is embodied as having a first transmission channel for transmitting one of control signals and control parameters to the magnetic cylinder and a second transmission channel for transmitting signals from the magnetic cylinder.

4. The device according to claim 1, one of wherein both electric energy and control signals can be transmitted via the transducer and wherein the transducer is configured for bidirectional signals transmission.

5. The device according to claim 1, wherein the magnetic cylinder is mounted rotatably in the frame walls, on two cylinder journals that protrude beyond a cylinder barrel of the magnetic cylinder at end faces thereof, whereby the magnetic cylinder can be removed, including the two cylinder journals, from the frame.

6. The device according to claim 1, wherein the bus system is provided for transmission of signals from an external controller on at least a last segment to a first data logic system comprised by the first transducer part that is fixed to the frame, for the contactless transmission to a second data logic system comprised by the second transducer part that is fixed to the cylinder, and from the second transducer part that is fixed to the cylinder to one of a control logic system of motor controllers and to a central control assembly of the associated motors for the at least some of the magnetic devices that each comprise a magnet that is rotatable by an associated motor.

7. The device according to claim 1, wherein at least at one end face of the magnetic cylinder a rotary feedthrough is provided, via which rotary feedthrough a line leading into the magnetic cylinder at the at least one end face thereof can be connected to a vacuum source.

8. The device according to claim 1, wherein at least some of the plurality of magnetic devices one of are and can be arranged on the magnetic cylinder such that at least some of the plurality of magnetic devices are positionable in a circumferential direction of the magnetic cylinder.

9. The device according to claim 8, wherein an assembly for transmitting one of electric power and signals to the plurality of magnetic devices is provided such that an electrical line connection between line branches, which are routed in the magnetic cylinder, and the motor and a motor controller for controlling the motor is maintained even with a displacement of the plurality of magnetic devices in the circumferential direction.

10. The device according to claim 8, wherein on at least some of the magnetic devices to be operated, electrical connector elements are provided, which can be placed in electrically conductive contact with ends of line branches that transmit one of electric power and electrical control signals and are configured as having excess length, and via which the one of electric power and the electrical control signals can be supplied to a relevant one of the plurality of magnetic devices.

11. The device according to claim 10, wherein the connector elements of the plurality of magnetic devices are provided on a supporting element, wherein a part of the plurality of magnetic devices that comprises the magnets, and the motor that rotates the magnets one of is and can be detachably mounted one of on and in the supporting element.

12. The device according to claim 1, wherein a UV dryer is directed toward the transport path of the substrate, toward a point in a section of the transport path that leads over the magnetic cylinder.

13. A machine for producing optically variable image elements on a substrate, comprising;

a printing substrate infeed;

at least one printing unit having at least one printing couple, by the use of which at least one printing couple, substrate that is guided along a transport path through the machine one of and can be printed at least on a first side a product receiving unit for receiving the substrate treated in the machine, and;

a device for aligning ones of magnetic and magnetizable particles, according to claim 1, and being provided in the transport path of the substrate between the at least one printing unit and the product receiving unit, wherein the magnetic cylinder is mounted rotatably in the frame walls on two cylinder journals, which protrude beyond a cylinder barrel of the magnetic cylinder, at end faces thereof, A whereby the magnetic cylinder can be removed, along with cylinder journals from the frame walls.

14. The machine according to claim 13, whereby, as an image-producing cylinder, the printing couple comprises a forme cylinder having, on a circumference of the forme cylinder, a multiplicity of image-producing ones of print motifs and groups of image-producing print motifs, which are arranged in multiple columns that are spaced equidistant from one another transversely to a direction of transport over a circumferential length that corresponds to a length of a print image, and in multiple rows that are spaced equidistant from one another in the direction of transport over a cylinder width that corresponds to a width of the print image.

* * * * *